US007762573B2

(12) United States Patent
Zaloom et al.

(10) Patent No.: US 7,762,573 B2
(45) Date of Patent: Jul. 27, 2010

(54) FOOTBED FOR GLIDING BOARD BINDING

(75) Inventors: Kahlil Zaloom, Essex Junction, VT (US); Christopher C. Cunningham, Burlington, VT (US); Florian Lang, Colchester, VT (US); Matt Windt, Chelmsford, VT (US); Christopher M. Doyle, Bolton Valley, VT (US); Richard William Wagner, Jr., Waterbury, VT (US); Ryan Larson, Waterbury, VT (US); Gregory Aaron Dean, Shelburne, VT (US); Greg Reagan, Essex, VT (US)

(73) Assignee: The Burton Corporation, Burlington, VT (US)

( * ) Notice: Subject to any disclaimer, the term of this patent is extended or adjusted under 35 U.S.C. 154(b) by 270 days.

(21) Appl. No.: 11/825,652

(22) Filed: Jul. 6, 2007

(65) Prior Publication Data

US 2008/0030000 A1 Feb. 7, 2008

Related U.S. Application Data

(60) Provisional application No. 60/819,131, filed on Jul. 7, 2006.

(51) Int. Cl.
*A63C 9/00* (2006.01)

(52) U.S. Cl. ..... 280/618; 280/611; 280/617

(58) Field of Classification Search ..... 280/14.21, 280/14.22, 14.24, 607, 11.14, 11.15, 611, 280/613, 616, 617, 618, 619, 620, 623, 624, 280/626–629, 633, 636

See application file for complete search history.

(56) References Cited

U.S. PATENT DOCUMENTS 3,943,882 A * 3/1976 Sollak et al. ..... 116/303

(Continued)

FOREIGN PATENT DOCUMENTS

DE 19603790 4/1997

(Continued)

OTHER PUBLICATIONS

Annex of the Partial International Search, Application No. PCT/US2007/015512 dated Feb. 29, 2008.

(Continued)

*Primary Examiner*—S. Joseph Morano
*Assistant Examiner*—Jacob Meyer
(74) *Attorney, Agent, or Firm*—Wolf, Greenfield & Sacks, P.C.

(57) ABSTRACT

A method and apparatus for providing a gliding board binding, such as a snowboard binding. The binding may include an adjustment indicator that allows for determination of a longitudinal position of the base relative to a gliding board, heel-to-toe position of the base relative to a gliding board and/or an angular position of the base relative to a gliding board when the base is secured to the gliding board. The adjustment indicator may be included with a footbed that is removable from a binding base, e.g., that includes a foot engagement member to secure a rider's foot to the binding and board. A removable footbed may include a toe portion that is adjustable in position relative to a heel portion of the footbed. A gliding board may include a channel for mounting a binding that is arranged in the board core so that no portion of the board core is located on top or bottom sides of the channel, and instead so the top and bottom reinforcement layers are located above and below the channel.

27 Claims, 6 Drawing Sheets

U.S. PATENT DOCUMENTS

| | | | | |
|---|---|---|---|---|
| 4,753,021 | A | 6/1988 | Cohen | |
| 4,973,073 | A * | 11/1990 | Raines et al. | 280/624 |
| 5,343,639 | A | 9/1994 | Kilgore et al. | |
| 5,353,523 | A | 10/1994 | Kilgore et al. | |
| 5,417,443 | A * | 5/1995 | Blattner et al. | 280/14.21 |
| 5,461,800 | A | 10/1995 | Luthi et al. | |
| 5,499,838 | A * | 3/1996 | Hauglin et al. | 280/615 |
| 5,503,900 | A * | 4/1996 | Fletcher | 428/160 |
| 5,660,410 | A * | 8/1997 | Alden | 280/627 |
| 5,822,866 | A | 10/1998 | Pardue | |
| 5,909,894 | A | 6/1999 | Meader et al. | |
| 5,927,744 | A * | 7/1999 | Knapschafer | 280/619 |
| 5,971,407 | A | 10/1999 | Zemke et al. | |
| 6,056,312 | A * | 5/2000 | Hogstedt | 280/624 |
| 6,113,114 | A | 9/2000 | Zemke et al. | |
| 6,174,212 | B1 * | 1/2001 | Chang | 441/70 |
| 6,247,709 | B1 | 6/2001 | Couderc | |
| 6,315,305 | B1 * | 11/2001 | Gien | 280/14.24 |
| 6,412,793 | B2 | 7/2002 | de France | |
| 6,457,261 | B1 | 10/2002 | Crary | |
| 6,487,796 | B1 | 12/2002 | Avar et al. | |
| 6,546,648 | B2 | 4/2003 | Dixon | |
| 6,554,295 | B2 * | 4/2003 | Rittmeyer | 280/11.3 |
| 6,575,490 | B1 * | 6/2003 | Laughlin | 280/618 |
| 6,595,542 | B2 * | 7/2003 | Okajima | 280/613 |
| 6,631,919 | B1 * | 10/2003 | West et al. | 280/633 |
| 6,641,163 | B2 | 11/2003 | Joubert des Ouches | |
| 6,644,681 | B2 | 11/2003 | Couderc et al. | |
| 6,648,365 | B1 * | 11/2003 | Laughlin et al. | 280/624 |
| 6,722,688 | B2 * | 4/2004 | Poscich | 280/618 |
| 6,726,238 | B2 * | 4/2004 | Poscich | 280/624 |
| 6,729,641 | B2 * | 5/2004 | Okajima et al. | 280/613 |
| 6,733,030 | B2 * | 5/2004 | Okajima et al. | 280/613 |
| 6,733,031 | B2 * | 5/2004 | Okajima et al. | 280/613 |
| 6,742,800 | B2 * | 6/2004 | Okajima | 280/613 |
| 6,758,488 | B2 * | 7/2004 | Laughlin et al. | 280/624 |
| 6,808,183 | B2 * | 10/2004 | Schaller et al. | 280/14.22 |
| 6,871,869 | B2 * | 3/2005 | Okajima | 280/613 |
| 6,880,267 | B2 | 4/2005 | Smaldone et al. | |
| 6,889,997 | B2 * | 5/2005 | Okajima | 280/625 |
| 6,898,870 | B1 | 5/2005 | Rohde | |
| 6,964,120 | B2 | 11/2005 | Cartier et al. | |
| 6,976,684 | B2 * | 12/2005 | Carrasca | 280/14.22 |
| 6,991,240 | B2 * | 1/2006 | Grella et al. | 280/14.21 |
| 7,077,403 | B2 * | 7/2006 | Laughlin et al. | 280/11.36 |
| 7,134,928 | B1 * | 11/2006 | Cannon | 441/70 |
| 7,204,495 | B2 * | 4/2007 | Reuss et al. | 280/11.36 |
| 7,287,776 | B2 * | 10/2007 | Papon | 280/636 |
| 7,309,077 | B2 * | 12/2007 | Couderc | 280/607 |
| 7,503,579 | B2 * | 3/2009 | Couderc | 280/623 |
| 7,566,062 | B2 * | 7/2009 | Reuss et al. | 280/11.36 |
| 2001/0001520 | A1 | 5/2001 | Gyr | |
| 2001/0013686 | A1 | 8/2001 | Marmonier | |
| 2001/0015543 | A1 * | 8/2001 | Joubert Des Ouches | 280/624 |
| 2001/0038182 | A1 * | 11/2001 | Carlson | 280/14.22 |
| 2002/0153702 | A1 * | 10/2002 | Okajima et al. | 280/613 |
| 2003/0197349 | A1 * | 10/2003 | Laughlin et al. | 280/624 |
| 2003/0197350 | A1 * | 10/2003 | Laughlin et al. | 280/624 |
| 2004/0049946 | A1 | 3/2004 | Lucas et al. | |
| 2004/0128860 | A1 | 7/2004 | Smaldone et al. | |
| 2004/0145156 | A1 * | 7/2004 | Grella et al. | 280/636 |
| 2004/0194347 | A1 | 10/2004 | Aveni et al. | |
| 2004/0232658 | A1 * | 11/2004 | Poscich | 280/618 |
| 2005/0040624 | A1 * | 2/2005 | Papon | 280/636 |
| 2005/0046150 | A1 | 3/2005 | Couderc | |
| 2005/0167933 | A1 * | 8/2005 | Couderc | 280/14.24 |
| 2005/0280248 | A1 * | 12/2005 | Jean | 280/623 |
| 2006/0001238 | A1 * | 1/2006 | Couderc | 280/617 |
| 2006/0145435 | A1 * | 7/2006 | Holzer | 280/14.24 |
| 2006/0170196 | A1 * | 8/2006 | Couderc | 280/607 |
| 2006/0237920 | A1 * | 10/2006 | Steere | 280/11.36 |
| 2007/0029759 | A1 * | 2/2007 | O'Hara | 280/618 |
| 2007/0045989 | A1 * | 3/2007 | Cunningham et al. | 280/618 |
| 2007/0114763 | A1 * | 5/2007 | Reuss et al. | 280/623 |
| 2007/0138766 | A1 * | 6/2007 | Couderc | 280/618 |
| 2007/0216137 | A1 * | 9/2007 | Ritter | 280/623 |
| 2008/0122201 | A1 * | 5/2008 | Furr et al. | 280/611 |
| 2008/0122202 | A1 * | 5/2008 | Furr et al. | 280/626 |
| 2009/0146397 | A1 * | 6/2009 | Steere | 280/624 |

FOREIGN PATENT DOCUMENTS

| | | | |
|---|---|---|---|
| DE | 19603790 | A1 * | 4/1997 |
| EP | 1018350 | | 7/2000 |
| EP | 1018350 | A1 * | 7/2000 |
| EP | 1125604 | | 8/2001 |
| EP | 1 149 610 | A | 10/2001 |
| EP | 2052765 | | 4/2009 |
| FR | 2645036 | | 10/1990 |
| FR | 2736842 | | 1/1997 |
| FR | 2 858 940 | A | 2/2005 |
| FR | 2858940 | | 2/2005 |
| FR | 2862545 | | 6/2005 |
| FR | 2865659 | | 8/2005 |
| FR | 2865659 | A1 * | 8/2005 |
| FR | 2894837 | | 6/2007 |
| WO | WO 03/051472 | | 6/2003 |

OTHER PUBLICATIONS

International Search Report and Written Opinion, International Application No. PCT/US2007/015512, dated May 13, 2008.

Extended European Search Report for EP 09164899.8 dated Aug. 14, 2009.

Extended European Search Report for EP 09164900.4 dated Sep. 7, 2009.

Extended European Search Report for EP 09011537.9 dated Feb. 3, 2010.

* cited by examiner

FOOTBED FOR GLIDING BOARD BINDING

This application claims the benefit of U.S. provisional application 60/819,131, filed Jul. 7, 2006, which is hereby incorporated by reference in its entirety.

BACKGROUND OF INVENTION

Bindings are widely used to secure a rider's foot to a gliding board, whether a snowboard, wakeboard, water ski, snow ski, and so on. One such type of binding includes a so-called "baseless" binding in which a rider's foot may be placed directly on the gliding board surface and be secured in place by a binding that partially surrounds the foot. For example, U.S. Pat. No. 6,641,163 discloses a baseless binding arrangement in which an interface element is positioned between the sole of the rider's boot and the top side of the gliding board. The interface element includes at least one zone that is made of a thermoformable material that is capable of matching the imprint of the sole of the rider's boot, allowing the boot to be immobilized precisely in position with respect to the binding.

SUMMARY OF INVENTION

In one aspect of the invention, a binding for use with a gliding board includes a footbed constructed and arranged to support a rider's foot, and a base constructed and arranged to be secured to a gliding board and to engage with the footbed portion. As used herein, a "foot" means a bare foot as well as a foot covered by footwear, such as a sock, shoe, sneaker, boot, etc. The base may be constructed and arranged to allow a rider's foot to directly contact the gliding board when secured to the gliding board without the footbed, i.e., may be used as a conventional "baseless" binding. At least one foot engagement member may be secured to the base and constructed and arranged to secure the rider's foot relative to the base. For example, one or more binding straps, step-in binding engagement devices or other suitable arrangements may be used to secure a rider's boot to the base. A highback may be secured to the base and constructed and arranged to support a rider's leg. The footbed may include an adjustment indicator that allows for determination of a longitudinal position, heel-to-toe position and/or an angular position when the base is secured to a gliding board. According to this aspect of the invention, a footbed that is removable from a binding base may provide indicator features that may help a rider accurately position the binding on a board during mounting.

In another aspect of the invention, a binding for use with a gliding board includes a footbed constructed and arranged to support a rider's foot and that has a heel portion and a toe portion that are attached to each other (either directly or indirectly via an intermediate member or members). The binding base may be constructed and arranged to be secured to a gliding board and to operate with the footbed. However, the base may be constructed and arranged to allow a rider's foot to directly contact the gliding board when secured to the gliding board without the footbed. At least one foot engagement member may be secured to the base and constructed and arranged to secure the rider's foot relative to the base. A highback may be secured to the base and constructed and arranged to support a rider's leg. The toe portion of the footbed may be adjustable in position relative to the heel portion, e.g., in the heel-to-toe direction, and the footbed may be removed from the base. In accordance with this aspect of the invention, a binding may include a removable footbed (thereby providing a conventional "baseless" binding), and if used, the footbed may provide a rider with an adjustable toe ramp feature, e.g., to accommodate different boot types and/or differently sized feet. This aspect of the invention may be used with the adjustment indicator feature described above, if desired.

In another aspect of the invention, a binding for use with a gliding board may include a footbed constructed and arranged to support a rider's foot, and a base constructed and arranged to be secured to a gliding board and to engage with the footbed. The footbed in this aspect of the invention may be permanently affixed to the base (e.g., integrally molded with the base) or may be removable from the base so that the base may be used as a baseless binding. At least one foot engagement member may be secured to the base and constructed and arranged to secure the rider's foot relative to the base, and a highback may be secured to the base and constructed and arranged to support a rider's leg. The binding may include an indicator element that is engageable with the gliding board to remain stationary relative to the gliding board in at least heel-to-toe and angular directions, yet the indicator element may be movable independent of the footbed and the base, thereby providing an indication of a heel-to-toe position and/or an angular position of the footbed and base relative to the gliding board. The indicator element may be separate and apart from any hold down disk that might be used to mount the binding to a board. For example, the indicator element may be a member that is attached to the footbed, but is allowed to move independently of the footbed so as to provide an indication of the footbed's position relative to the board.

In another aspect of the invention, a method for mounting a snowboard binding to a gliding board includes providing a snowboard binding having footbed removably mounted to a base, with the footbed including an adjustment indicator for determination of a longitudinal position, heel-to-toe position and/or an angular position of the binding when secured to a gliding board. A gliding board is provided, and the base is secured to the gliding board. A position of the snowboard binding may be determined using the adjustment indicator.

In another aspect of the invention, a snowboard includes a top reinforcement layer, a bottom reinforcement layer, and a core (e.g., made of wood strips secured together) positioned between the top and bottom reinforcement layers. A channel for mounting a binding to the board may be secured within an opening in the core such that no portion of the core is located above or below the channel, and so that the top reinforcement layer is positioned above the channel, and the bottom reinforcement layer is positioned below the channel. In one embodiment, the channel may be a metal member having a "C" shaped cross section and may be constructed and arranged to receive a fastener (e.g., a T-nut) for mounting a binding to the snowboard.

These and other aspects of the invention will be appreciated from the following description and claims.

BRIEF DESCRIPTION OF THE DRAWINGS

Aspects of the invention are described below with reference to the following drawings in which like numerals reference like elements, and wherein.

DETAILED DESCRIPTION

It should be understood that aspects of the invention are described herein with reference to the figures, which show illustrative embodiments in accordance with aspects of the invention. The illustrative embodiments described herein are not necessarily intended to show all aspects of the invention, but rather are used to describe a few illustrative embodiments. For example, although aspects of the invention are described below with reference to a snowboard binding used in conjunction with a snowboard, aspects of the invention may be used with any suitable gliding board and corresponding binding. Thus, aspects of the invention are not intended to be construed narrowly in view of the illustrative embodiments. In addition, it should be understood that aspects of the invention may be used alone or in any suitable combination with other aspects of the invention.

As discussed above, one aspect of the invention relates to providing an adjustment indicator with a binding so as to provide an indication of position of the binding (the base and/or footbed) relative to the board on which the binding is mounted. The adjustment indicator may include one or more parts, e.g., a viewing window formed in the footbed, and an indicator element, e.g., a planar member, that is attached to the footbed and viewable in the window. Although attached to the footbed, an indicator element may be moveable relative to the footbed or base, e.g., the element may be mounted in a pocket in the footbed and be movable within a plane that is substantially parallel to the top surface of a board to which the binding is mounted. The indicator element may be separate and apart from a hold down disk (if any) used to mount the binding to the gliding board, and may engage with the gliding board to remain stationary relative to the gliding board in at least heel-to-toe and angular directions despite movement of the binding relative to the board. The indicator element may engage with the board in any suitable way, such as by one or more fasteners, adhesive (whether permanent or not), a rib or tab that engages with a corresponding slot or hole in the board, a hole in the indicator element that engages with a pin or other element on the board, and so on. Thus, the footbed and the base may be moved independent of the indicator element in heel-to-toe and/or angular directions so that the indicator element may provide an indication of a heel-to-toe position and/or an angular position of the footbed and base relative to the gliding board. The indicator element may also provide an indication of a longitudinal position of the binding relative to the board, e.g., by way of a pointer, marking or other feature that may be aligned with a marking or other feature on the board and viewed by the rider.

Figure 1:
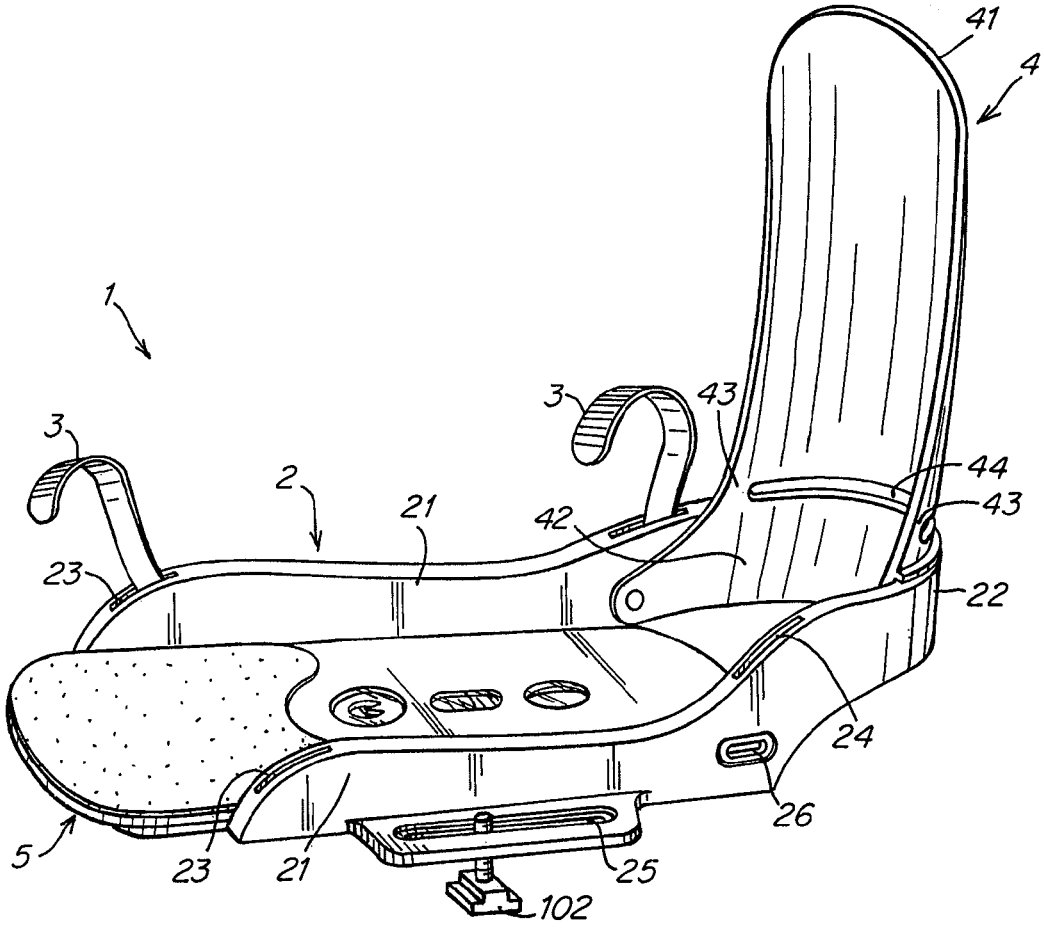
FIG. 1 shows a perspective view of a binding in accordance with the invention.

FIG. 1 shows a perspective view of a snowboard binding 1 that incorporates various aspects of the invention. This illustrative embodiment includes a base 2 with opposite sidewalls 21 and a heel hoop 22 that extends around a rider's heel and connects the heel-side ends of the sidewalls 21. In this embodiment, the sidewalls 21 and heel hoop 22 are molded as a single unitary piece (e.g., using a fiber-reinforced plastic), but the sidewalls 21 and heel hoop 22 may be made separately and then attached together. The sidewalls 21 each include a toe strap slot 23 and an ankle strap slot 24 used to mount a strap portion for toe and ankle straps 3, respectively. Of course, those of skill in the art will appreciate that binding straps may be attached to the sidewalls 21 without the use of slots 23 and 24, e.g., using holes formed in the sidewalls 21 that receive a screw or other fastener to engage with an end of the binding straps 3. Moreover, it should be understood that any suitable type of engagement member(s) 3 may be used to secure a rider's foot relative to the base 2, such as any suitable number or type of foot straps that use typical ratchet buckles to engage two strap members together, boot engagement members used to secure a boot in step-in type bindings, or any other arrangement.

The sidewalls 21 each include a slot 25 to receive a screw or other fastener for securing the base 2 relative to a gliding board, such as a snowboard. The slots 25 may be molded integrally with the sidewalls 21, and may have a metal insert or other reinforcement to support the fastener. For example, in one embodiment, the slot 25 may include a steel washer that surrounds each slot 25. In this illustrative embodiment, the base 2 is secured to a snowboard using a threaded fastener and T-nut arrangement 102, although other arrangements may be used. For example, in some aspects of the invention, the base 2 may be secured to a board using a hold down disk, standard screws, or any other suitable arrangement. Likewise, the base 2 may be arranged to cooperate with any suitable fastening arrangement, e.g., a 4×4, 3D(R) or other threaded insert pattern used in snowboards. This illustrative embodiment is arranged to operate with a channel-type slot in a board, as discussed in more detail below.

The binding 1 in this illustrative embodiment also includes a highback 4 that is secured to the sidewalls 21 at slots 26 formed in the sidewalls 21. Although the highback 4 may be mounted to the sidewalls 21 using simple holes, the slots 26 may allow the highback 4 to be rotated and fixed in place relative to the base 2 within a range of angles about an axis that extends generally along the length of a rider's lower leg. The highback 4 may be constructed in any suitable way, but in this embodiment is formed to have a slot 44 formed across the highback 4 so that the upper portion 41 of the highback is attached to the lower portion 42 by living hinge members 43. The living hinges 43 may allow the upper portion 41 to be moved relative to the lower portion 42, e.g., by operating a forward lean adjuster mechanism (not shown) as known in the art. Of course, the highback 4 may be formed as a solid member with no slot 44, or the upper portion 41 may be connected to the lower portion 42 by a hinge pin or other suitable arrangement.

In accordance with one aspect of the invention, the binding 1 includes a footbed 5 that is removably attached to the base 2. By "removably attached," it is meant that the footbed 5 may be removed from the base 2 by removal of one or more screw or other fasteners, or may be removed in a tool-free manner. This is in contrast to most snowboard bindings in which the portion that supports the bottom of the rider's foot is molded integrally with or otherwise permanently attached to the sidewalls, heel hoop and other portions of the binding. Thus, in one illustrative embodiment, the footbed 5 may be removed from the base 2, e.g., for replacement if worn and/or to change performance features of the binding. For example, some footbeds 5 may be arranged to provide more cushion or shock absorbance, whereas other footbeds 5 may be made more stiff and provide the rider with improved feel of the board on the gliding surface. Thus, a plurality of different footbeds 5 may be made to operate with a single base 2. (In some embodiments, the base 2 may be used without a footbed 5, i.e., with at least portions of the sole of a rider's foot in direct contact with the board to which the base 2 is mounted.)

Figure 2:
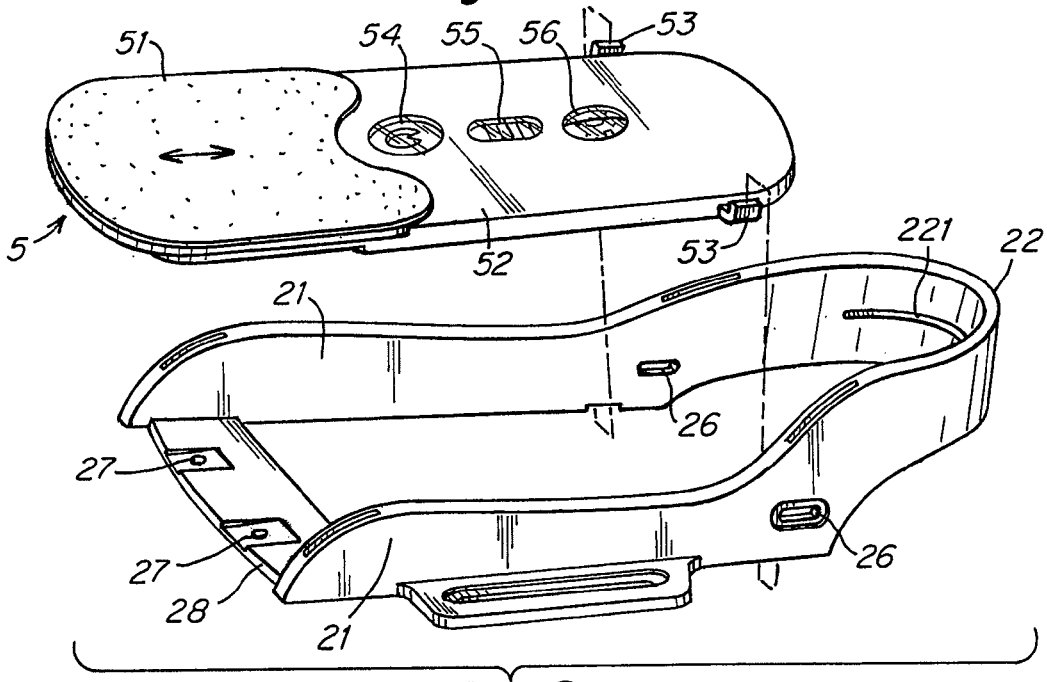
FIG. 2 shows an exploded view of the binding of FIG. 1.

FIG. 2 shows an exploded view of the binding 1 with the footbed 5 removed from the base 2 in this illustrative embodiment. In accordance with another aspect of the invention, the footbed 5 includes a toe portion 51 that is attached and moveable in a heel-to-toe direction relative to a heel portion 52, e.g., to accommodate different sized feet and/or boot shapes. Although referred to as the "toe portion" and the "heel portion," each of the portions of the footbed 5 may support additional portions of the rider's foot, such as portions near the middle of the foot. Moreover, the footbed 5 may include more than two portions, such as a central portion, a heel portion and a toe portion, with the heel and toe portions being movable relative to the central portion. In this illustrative embodiment, the heel portion 52 remains stationary relative to the base 2 and engages with the base 2 by way of right angle tabs or lugs 53 which slide into slots formed in the bottom of the sidewalls 21. When the base 2 is attached to a board, the tabs 53 are captured in the slots of the sidewalls 21 and maintain the heel portion 52 in place relative to the base 2. Other arrangements are possible for engaging the heel portion 52 (or other part of the footbed 5, such as a central portion) including tabs that extend laterally from the sides of the footbed 5 and that engage with lateral slots formed in the sidewalls 21. Such an arrangement may allow the footbed 5 to be removed from the binding 1 without removing the base 2 from a board. Other arrangements will occur to those of skill in the art, such as screw, adhesive or other fastener engagements between the footbed 5 and the base 2, the footbed 5 may have wings or a flange that is trapped between the base 2 and the board when the binding 1 is mounted, the footbed 5 may include laterally extending portions that slide into grooves in the sidewalls 21 that extend in the heel-to-toe direction, and others. It is also possible for the footbed 5 to be secured directly to the board, and not necessarily be secured to the base 2.

In this embodiment, the toe end of the footbed 5 is connected by screws (not shown) or other fasteners that pass through holes 27 in a crossbar 28 of the base 2 and engage with the toe portion 51. Thus, in addition to the lugs 53, the footbed 5 may be secured to the base 2 in part by fasteners that engage the footbed 5 at the crossbar 28. As is discussed in more detail below, the connection between the footbed 5 and the crossbar 28 may permit the toe portion 51 to be moved in a heel-to-toe direction without requiring the footbed 5 to be disconnected from the base 2.

In another aspect of the invention, the footbed 5 includes three adjustment indicators, although fewer or more indicators may be used, or a single indicator may provide multiple binding position indications. The adjustment indicators allow a rider to determine the position of the binding 1 relative to the board, specifically a longitudinal position of the binding 1 in a tip-to-tail direction on the board, a heel-to-toe position, and/or an angular position (e.g., a rotational position of the binding about a vertical axis that is generally perpendicular to the top surface of the board). A first indicator 54 provides a window through the footbed 5 so that the rider can see a portion of the board underlying the first indicator 54. The indicator 54 may include a pointer, arrow or other feature that, for example, is located at a lateral centerpoint or other suitable location on the binding. The pointer or arrow may be aligned with a suitable mark on the board, such as a hash mark, a rider applied marking, or other feature on the board that indicates the desired location on the board for the binding. A second indicator 55 may provide an indicator for heel-to-toe position of the binding on the board. As will be discussed in more detail below, a portion of the footbed 5 may engage with the board and remain stationary in a heel-to-toe direction as the binding is adjusted. The stationary portion may include hash marks or other features that indicate, for example, a heel-to-toe centerpoint of the binding, and a plurality of other marks on either side of the centerpoint. A third indicator 56 may provide an indication of an angle of the binding 1 relative to the board. Again, a portion of the footbed 5 may engage with the board and remain stationary as the binding is adjusted angularly. Angle markings or other suitable features may be viewed by the rider during adjustment to determine a desired angular position of the binding on the board. In accordance with this aspect of the invention, a rider may be able to view and set longitudinal position, heel-to-toe position and angular position while viewing indicators on the binding that are located together. This arrangement may allow a rider to more easily make binding adjustments.

Figure 3:
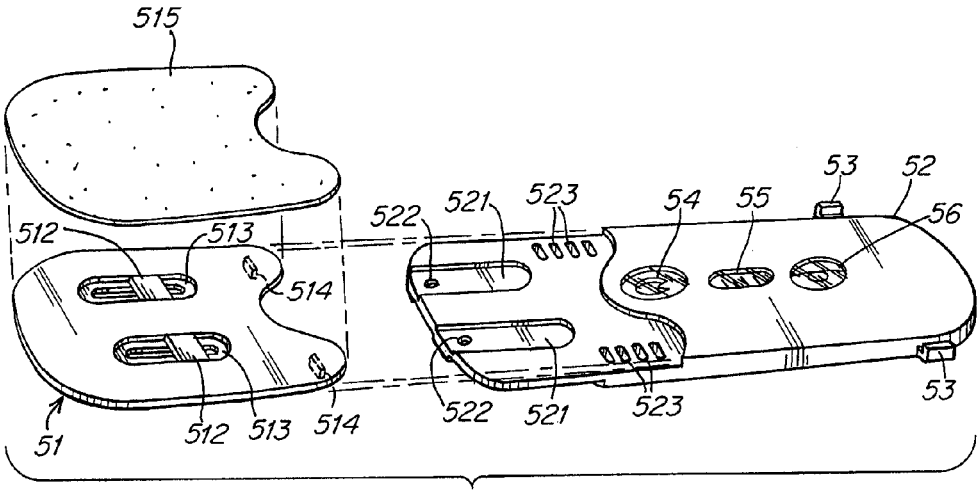
FIG. 3 shows a top exploded view of the footbed for the binding.

FIG. 3 shows an exploded top view of the footbed 5 in this illustrative embodiment. This view shows more clearly the arrow or other indicator feature provided for the first indicator 54. Also, the indicators 54, 55 and 56 may include a magnifying lens or other element that enlarges the markings, arrows or other features used to align the binding 1. The view windows for the indicators 54, 55 and 56 may include a reference line or other feature to help identify the center or other portion of the viewing window. In one embodiment, the reference line is molded into the window, e.g., is formed by a mold parting line or similar feature in the transparent window material. This arrangement may provide a ready reference without requiring an opaque marking.

As can also be seen in FIG. 3, the toe end of the heel portion 52 includes a pair of grooves 521 that receive complementary raised portions (see reference number 511 in FIG. 4) and help keep the toe portion 51 in proper alignment with the heel portion 52. The screws (not shown) that extend through the holes 27 in the crossbar 28 of the base 2 to engage the footbed 5 extend through the holes 522 in the heel portion 52 and into T-nuts 512 that ride in slots 513 in the top of the toe portion 51. Accordingly, with the screws engaged with the T-nuts 512, the toe portion 51 is adjustable in the heel-to-toe direction so long as the screws are not tightened. Once the toe portion 51 is positioned as desired, the toe portion 51 may be locked in place by engaging tabs 514 on the underside of the toe portion 51 with holes 523 in the heel portion 52. Thus, in this embodiment, the screws that engage the T-nuts 512 are not used to lock the toe portion 51 in place, although the screws and T-nuts 512 could be used to fix the toe portion 51 in other embodiments. As shown in FIG. 3, a cover member 515 may be secured over the toe portion 51 to capture the T-nuts 512 in the slots 513. The cover member 515 may be made of, or otherwise include, a foam or other material to help enhance grip for the rider's foot. A cover member or similar arrangement may also be provided on the heel portion 52, e.g., to improve a rider's grip, alter the appearance of the footbed 5, etc.

Figure 4:
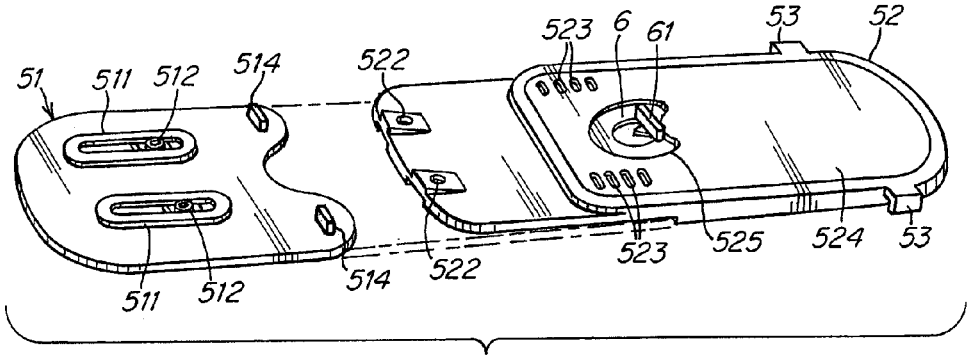
FIG. 4 shows a bottom exploded view of the footbed for the binding.

FIG. 4 shows a bottom exploded view of the footbed 5. In this view, the tabs 514 and corresponding holes 523 that permit the toe portion 51 to be fixed relative to the heel portion 52 between four discrete positions in the heel-to-toe direction can be more clearly seen. Of course, it will be understood that the toe portion 51 may have fewer or more discrete adjustment positions, or no discrete positioning in the heel-to-toe direction may be provided at all. Also shown are raised portions near the holes 522 in the heel portion 52. These raised portions engage with complementary recessed portions near the holes 27 in the crossbar 28 of the base 2 and may help properly locate the footbed 5 relative to the base 2.

Figure 5:
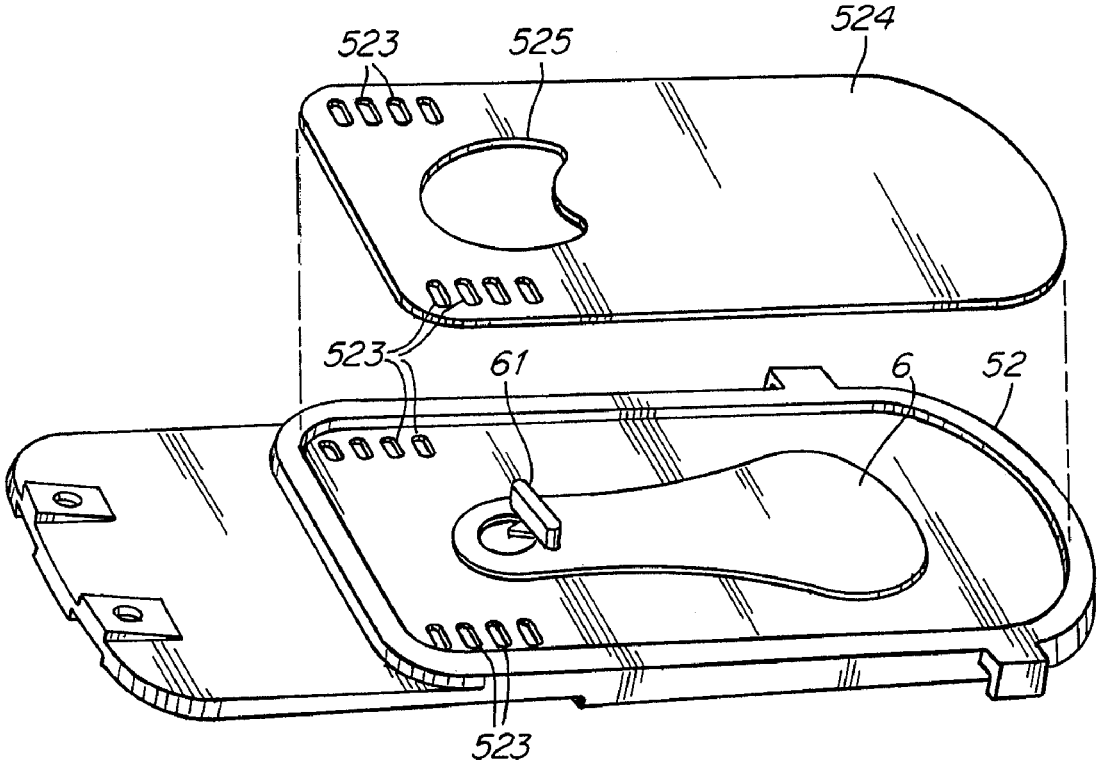
FIG. 5 shows an exploded view of the heel portion of the footbed.

In the bottom view of FIG. 4, a rib 61 of an indicator element 6 can be seen extending through an opening 525 in a bottom plate 524 of the footbed 5. The rib 61 may engage with the sides of a corresponding slot in a board when the binding 1 is mounted, and therefore may remain stationary relative to the board in heel-to-toe and angular directions when the base 2 is adjusted in position. However, in this embodiment, the rib 61 is arranged to allow for longitudinal (tip-to-tail) movement of the indicator element 6 (and binding 1) along the board to allow for longitudinal adjustment of the binding. FIG. 5 shows a bottom view of the footbed 5 with the bottom plate 524 removed. The bottom plate 524 fits within a recess in the heel portion 52 to capture the indicator element 6 in the recess. Although captured in the recess by the bottom plate 524, the indicator element 6 is free to move in the recess in a plane that is approximately parallel to the top surface of the board to which the binding is mounted. It is this movement of the indicator element 6 relative to the footbed 5 that allows the indicator element 6 to indicate the position of the binding 1 relative to the board. Movement of the indicator element 6 is limited, as desired, by the size and shape of the opening 525 and the size and shape of the recess in the heel portion 52.

Figure 6:
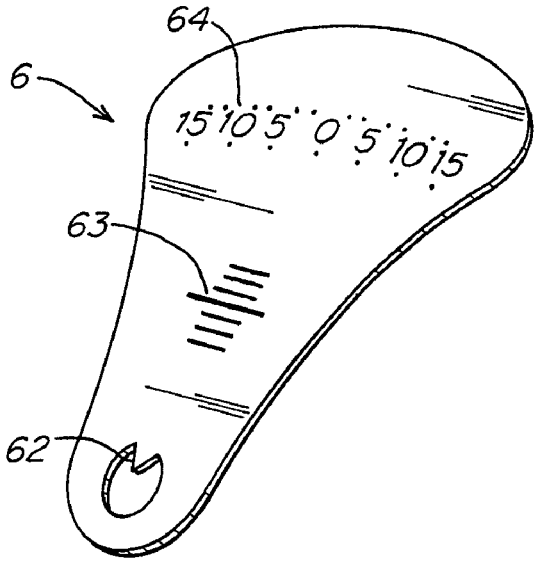
FIG. 6 shows an indicator element for the footbed.

FIG. 6 shows a top view of the indicator element 6 in this illustrative embodiment. The window and arrow pointer 62 for the first indicator 54 is formed by a hole in the flat plate of the indicator element 6. Hash marks 63 are formed on the indicator element 6 and are arranged to cooperate with the second indicator 55. A widest hash mark may indicate a center location for the binding 1 in the heel-to-toe direction, and fore and aft marks indicate alternate heel side and toe side locations from the centerpoint. Angle indication marks 64 are arranged to operate with the third indicator 56. The angle indication marks 64 (and other markings) may take any suitable form, such as the numbered marks shown, and may be provided with hash marks or any other marking arrangement.

Aspects of the invention relating to the adjustment indicator are not limited to bindings which have a removable footbed. For example, the footbed 5 described in the embodiments above may be permanently fixed to the base (e.g., glued, screwed, molded integrally at least in part, etc.), if desired. Alternately, in another embodiment, an indicator element similar to that described above may be incorporated into a standard tray-type or other binding with a fixed baseplate. In such embodiments, the indicator element may include a plate that is movable within a horizontally oriented slot in the baseplate, i.e., the portion that supports the sole of a rider's foot, in much the same way that the indicator element is movable in the recess in the footbed above. However, in this embodiment, the indicator element may include one or more holes to receive fasteners for securing the binding to the board, e.g., the holes may match an insert pattern such as the 4×4 or 3D pattern in a snowboard. Thus, the indicator element may be initially engaged with the board with the fasteners in a relatively loose condition so that the binding base is permitted to move on the board relative to the indicator element. Once the base is positioned as desired (the binding position may be determined in the same way as in the footbed embodiment above, except that indicator windows may be formed in the baseplate as opposed to a footbed), the fasteners may be tightened such that the indicator element clamps the base onto the board, e.g., in a way similar to some hold down disks.

In another illustrative embodiment, an indicator element, e.g., a sticker shaped like the indicator element 6, may be fixed to the board, and located so that the binding is placed over the indicator element. The binding, which may have a removable or fixed footbed, may include windows or other indicator features that allow viewing of portions of the indicator element so as to determine a binding location relative to the board.

Figure 7:
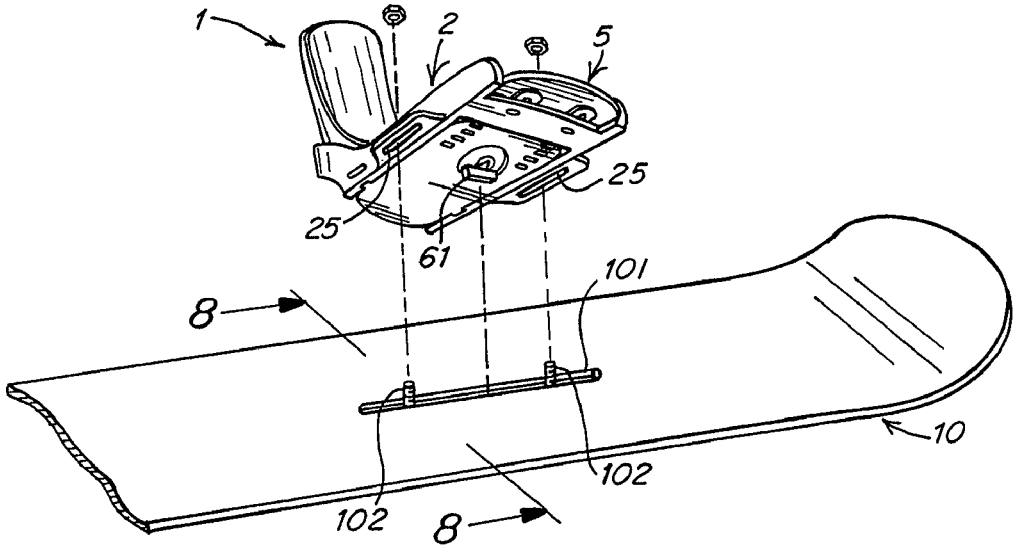
FIG. 7 shows the binding being mounted to a board.
Figure 8:
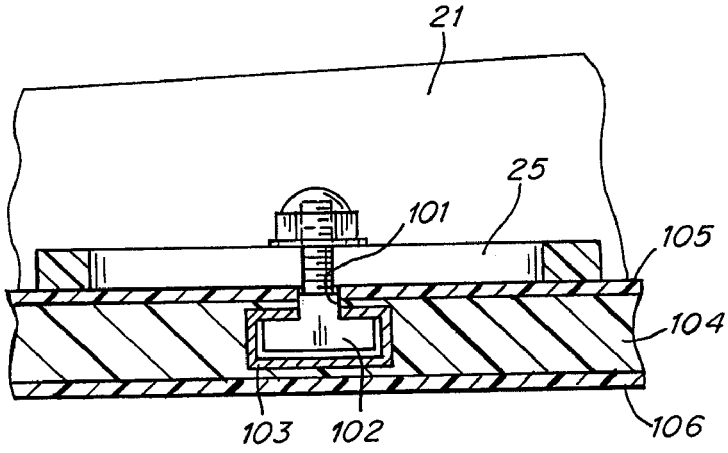
FIG. 8 shows a cross sectional view along the line 8-8 in FIG. 7.

FIG. 7 shows a view of the binding 1 in this illustrative embodiment being mounted on a board 10 having a slot-type mounting arrangement. The binding 1 is positioned on the board 10 so that the rib 61 on the indicator element 6 fits within the slot 101 in the board 10. Fasteners extend through the slots 25 on opposite sides of the sidewalls 21 and engage with T-nuts positioned in the slot 101. FIG. 8 shows a cross sectional view along the line 8-8 in FIG. 7 and shows the T-nuts 102 located in the slot 101 in the board 10. The slot 101 is formed by an aluminum channel 103 having an approximately rectangular cross section. The aluminum channel 103 is located in the board 10 between the top and bottom reinforcement layers 105 and 106. In this embodiment, the core 104 does not extend below or above the channel 103, and the top reinforcement layer 105 with the top sheet (e.g., a decorative layer) and the bottom reinforcement layer 106 with the base layer extend over the channel 103. Accordingly, no screw or other fastener is needed to secure the channel 103 in the board—instead, the channel 103 may be held in place by the top and bottom reinforcement layers 105 and 106 together with associated resin. In this illustrative embodiment, the T-nuts 102 have a threaded stud that extends up through the slot 101 and into the slot 25 of the binding 1. A suitable threaded sleeve or nut may engage with the stud to secure the binding 1 in place. The T-nuts 102 also have a top rib that extends into the slot 101 to help better secure the T-nut 102 in place. Of course, other arrangements are possible, e.g., a threaded bolt may extend downwardly through the slot 25 and into a threaded hole in the T-nut 102. In this embodiment, the channel 103 is formed of aluminum, but may be made of any other suitable metal, plastic or other material or combination of materials. The core 104 in this embodiment is formed of laminated strips of wood, but may be formed in any other suitable way, e.g., by a foam or any other material or combination of materials. The reinforcement layers 105 and 106 are formed of resin impregnated fabric, such as a fiberglass fabric, but other suitable reinforcing layers may be used.

Figure 9:
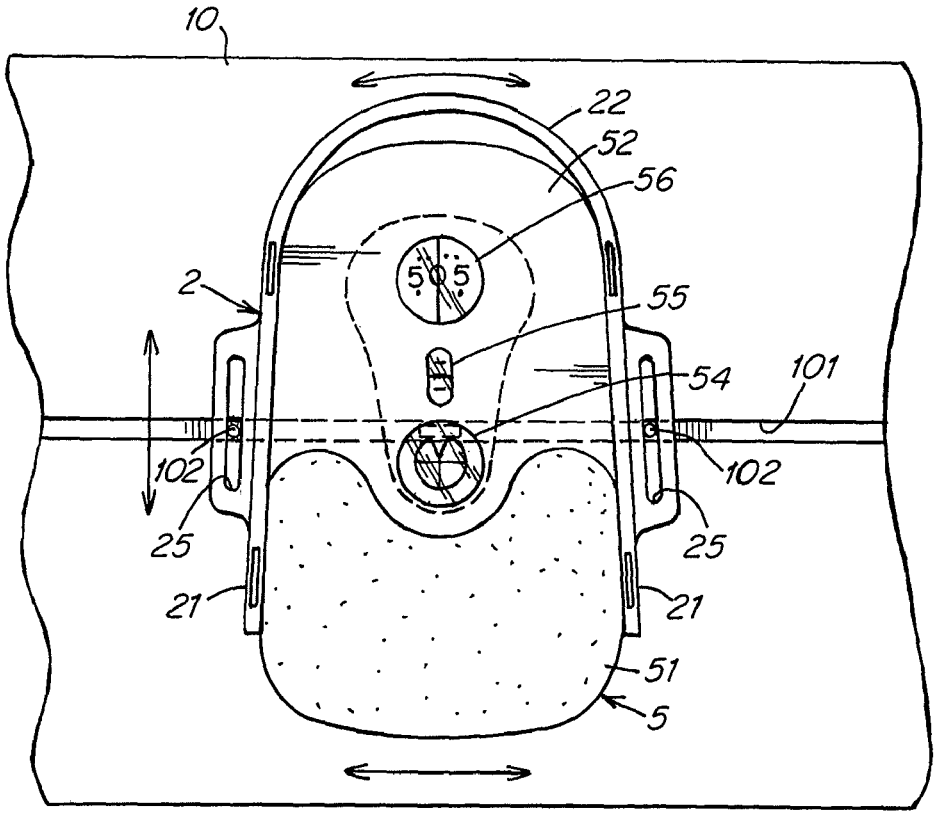
FIG. 9 shows a top view of the binding with possible adjustment directions indicated.

Given the slot 101 mounting arrangement, the binding 1 can be adjusted in longitudinal position on the board through a potentially wide range of positions, limited only by the length of the slot 101. Markings may be provided on the board near the slot 101 and may be viewed using the first indicator window 54 to confirm the longitudinal position of the binding 1. For example, as shown in FIG. 9, the binding 1 can be adjusted longitudinally, in a heel-to-toe direction and/or angularly because of the degrees of freedom provided by the slot 101 and the slots 25. That is, as the binding 1 is moved in a heel-to-toe direction and/or angularly relative to the slot 101, the indicator element 6 will remain stationary relative to the slot 101. Thus, the rider may view the relative heel-to-toe position and/or angular position of the binding using the indicators 55 and 56. Since a rider may view all three of the indicators 54, 55 and 56 in one place, accurate mounting of the binding may be made easier.

The engagement of the indicator element 6 with the board 10 may be achieved in ways other than by having a rib 61 contact sides of the slot 101. For example, a T-nut or similar element may be positioned in the channel 103 and have a member extend upwardly through the slot 101 and above the board top surface. The member may have a size, shape or other configuration to engage with a mating feature on the indicator element 6. In one illustrative embodiment, the member may have a special shape, such as a star shape, that engages with a corresponding star-shaped hole in the indicator element 6. This arrangement may allow the footbed 5 to be made with no parts depending below the bottom surface of the footbed 5, e.g., to allow the footbed to be used on boards that do not have a corresponding mating feature for the indicator element. In addition, this arrangement may help ensure that only proper bindings that have an appropriate mating feature in the indicator element 6 are used with a particular board. For example, boards requiring the use of a particular binding may include indicator element mating parts that have a six-sided star shape. Thus, only bindings with a six-sided star hole may be properly mated with the board. Boards requiring a different binding type may have differently shaped indicator element mating parts.

Figure 10:
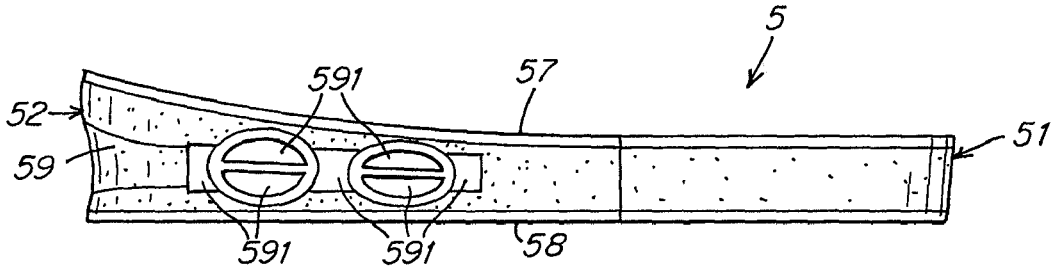
FIGS. 10 and 11 show alternate embodiments of a footbed incorporating a cushioning or other support element.
Figure 11:
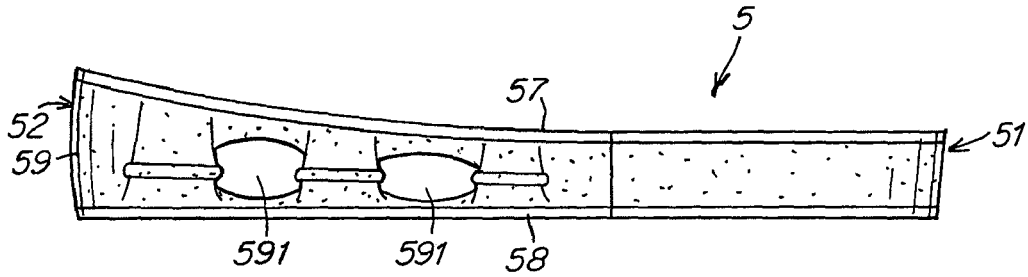

In one aspect of the invention, a variety of different types of footbeds 5 may be arranged for operation with a single type of base 2. The footbeds 5 may have a variety of different properties, such as different sizes, shapes, heights, indicator features, and so on. FIGS. 10 and 11 show two alternate embodiments for a footbed 5. As discussed above, the footbed 5 may include any suitable cushioning or other foot support elements. In the illustrative embodiments shown, the footbed 5 includes "pillar" type and other support elements similar to those found in some running shoes. The heel portion 52 of the footbeds 5 may be made with upper and lower plates 57 and 58 that are made of a substantially inflexible material, such as nylon. Between the upper and lower plates 57 and 58 may be positioned cushioning or other support elements 59 that may take any form. In these illustrative embodiments, the cushioning element 59 include through holes 591 that pass laterally through the cushioning element 59. The shape, material and/or other configuration of other portions of the cushioning elements 59 may be arranged to provide desired stiffness, resiliency or other features for the rider's foot. Moreover, the support features of the cushioning elements 59 may be varied within the footbed 5, e.g., to give more stiff support near the heel, and more resilient support near the midsole. As will be understood by those of skill in the art, the cushioning elements 59 may be made so that the rider can vary the stiffness or other support property, e.g., by providing removable elements that may be inserted into or removed from through holes 591. The footbed 5 may also be made to allow a rider to adjust the height of the footbed at one or more locations, e.g., allow a rider to insert cushioning elements 59 or other elements to raise the heel of the footbed 5. The footbed 5 may also be made to interlock with a rider's boot, e.g., a neoprene sheet may be provided on the upper plate 57 to improve grip, and/or a suitable material provided on the upper plate 57 may be molded to conform to the boot's tread pattern. Thus, a footbed 5 may be specially designed to operate with a particular boot or set of boots, and because of the way in which different footbeds may be combined with the same base 2, a wide range of different footbeds may be offered for each base style or design.

Figure 12:
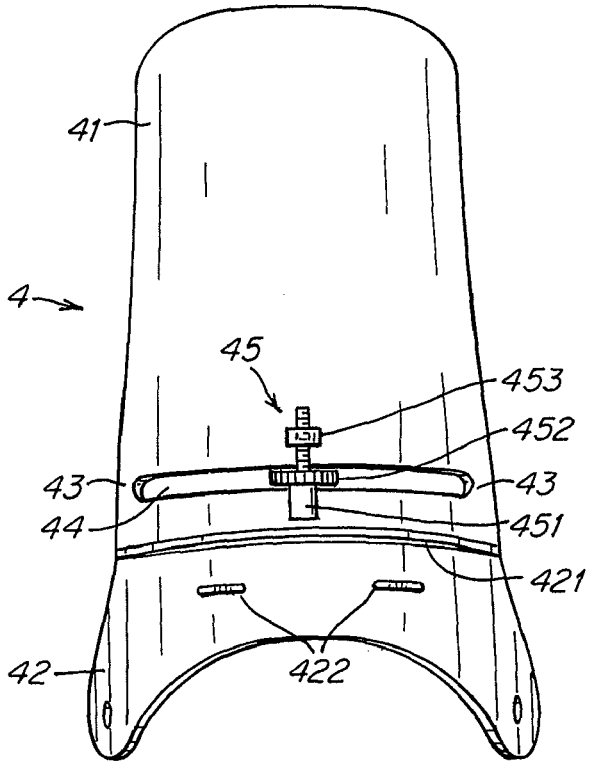
FIG. 12 shows a rear view of a highback for the binding.

In accordance with one aspect of the invention and as discussed above, the highback 4 includes an upper portion 41 and a lower portion 42 that are connected together at a living hinge portion 43. For example, the highback 4 may be molded as a single unitary part with a slot 44 that extends around the highback 4, leaving the upper and lower portions 41 and 42 connected only at the living hinge portions 43. The upper portion 41 may be adjusted in position relative to the lower portion 42, e.g., to adjust a forward lean of the highback 4. In this embodiment and as shown in a rear view of the highback 4 in FIG. 12, a forward lean adjuster member 45 may be provided that spans between the upper and lower portions 41 and 42 and allows a rider to selectively adjust the forward lean of the upper portion 41. The forward lean adjuster 45 may take any suitable form, and in this embodiment includes a threaded rod 451 that is mounted for rotation to the lower portion 42. A handle 452 is fixed to the threaded rod 451 to allow a user to rotate the rod without tools. A nut 453 may be fixed relative to the upper portion 41 and engage with the threaded rod so that as the threaded rod 451 is rotated, the upper portion 41 may be tilted forward or back relative to the lower portion 42. The lower portion 42 may also include a shelf 421 that contacts the heel hoop 22 to resist rearward movement of the highback 4 beyond a certain point. The lower portion 42 may also include a tab 422 or other feature to engage with the heel hoop 2 (e.g., at a groove 221 in the inner surface of the heel hoop—see FIG. 2) to releasably lock the highback 4 in an upward position. However, a user can release the highback 4 from the heel hoop 22 by rotating the highback 4 to a folded position about the slot mount 26.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A binding for use with a gliding board, comprising:

a footbed constructed and arranged to support a rider's foot;

a base constructed and arranged to be secured to a gliding board and to releasably engage with the footbed portion, the base being constructed and arranged to allow a rider's foot to directly contact the gliding board when the base is secured to the gliding board for riding without the footbed;

at least one foot engagement member secured to the base and constructed and arranged to secure the rider's foot relative to the base;

a highback secured to the base and constructed and arranged to support a rider's leg; and an adjustment indicator that cooperates with the footbed and base and allows for determination of a heel-to-toe position of the base relative to a gliding board or an angular position of the base relative to a gliding board when the base is secured to the gliding board, the adjustment indicator including an indicator element that is adapted to move relative to the base as the base is moved in a heel-to-toe direction relative to the gliding board, the indicator element including at least one visible feature indicating a heel-to-toe position or angular position of the base relative to the gliding board, wherein the indicator element is arranged to indicate a heel-to-toe position or angular position of the base relative to the gliding board for a plurality of different longitudinal positions of the base relative to the gliding board.

2. The binding of claim 1, wherein the base includes a pair of opposed sidewalls extending in a heel-to-toe direction, and a heel hoop that connects a heel end of the sidewalls.

3. The binding of claim 2, wherein the base further includes a crossbar that extends between the sidewalls, and wherein the footbed is arranged to be fastened to the crossbar.

4. The binding of claim 2, wherein the at least one foot engagement member includes a binding strap having an engagement portion engageable with, and selectively separable from, a buckle portion, and the sidewalls are each adapted to engage with an end of the engagement portion or the buckle portion.

5. The binding of claim 1, wherein the footbed includes a heel portion and a toe. portion, and wherein the toe portion is movable in a heel-to-toe direction relative to the heel portion.

6. The binding of claim 5, wherein the heel portion of the footbed is engageable with the base such that the heel portion is maintained stationary with respect to the base, and wherein the toe portion is moveable in the heel-to-toe direction relative to the heel portion with the heel portion maintained stationary relative to the base.

7. A binding for use with a gliding board, comprising:

a footbed constructed and arranged to support a rider's foot, the footbed including a heel portion and a toe portion, and wherein the toe portion is movable in a heel-to-toe direction relative to the heel portion;

a base constructed and arranged to be secured to a gliding board and to releasably engage with the footbed portion, the base being constructed and arranged to allow a rider's foot to directly contact the gliding board when secured to the gliding board without the footbed;

at least one foot engagement member secured to the base and constructed and arranged to secure the rider's foot relative to the base; and a highback secured to the base and constructed and arranged to support a rider's leg;

wherein the footbed includes an adjustment indicator that allows for determination of a longitudinal position of the base relative to a gliding board, heel-to-toe position of the base relative to a gliding board or an angular position of the base relative to a gliding board when the base is secured to the gliding board, and wherein the heel portion includes a pair of lugs that are engageable with the base and the lugs are trapped in engagement with the sidewalls when the base is secured to a gliding board.

8. The binding of claim 7, wherein the base includes a pair of opposed sidewalls extending in a heel-to-toe direction, and a heel hoop that connects a heel end of the sidewalls, and wherein the lugs are insertable into slots formed in a bottom of the sidewalls.

9. The binding of claim 1, wherein the footbed includes a ramped portion at a toe end of the footbed.

10. The binding of claim 7, comprising a first adjustment indicator including a first window attached to the footbed that permits viewing of a portion of the gliding board when the binding is mounted to the gliding board.

11. The binding of claim 10, wherein the first adjustment indicator includes a pointer element that is alignable with a marking on the gliding board viewed in the first window.

12. The binding of claim 1 wherein the indicator element includes a portion that depends from a bottom of the footbed and is adapted to engage with the gliding board such that the indicator element remains stationary relative to the gliding board as the base is moved in a heel-to-toe direction relative to the gliding board.

13. The binding of claim 1, wherein the indicator element is attached to the binding and is adapted to remain stationary relative to the gliding board as the base is moved in a heel-to-toe direction and an angular direction relative to the gliding board.

14. A binding for use with a gliding board, comprising:

a footbed constructed and arranged to support a rider's foot;

a base constructed and arranged to be secured to a gliding board and to releasably engage with the footbed portion, the base being constructed and arranged to allow a rider's foot to directly contact the gliding board when secured to the gliding board without the footbed;

at least one foot engagement member secured to the base and constructed and arranged to secure the rider's foot relative to the base; and a highback secured to the base and constructed and arranged to support a rider's leg;

wherein the footbed includes an adjustment indicator that allows for determination of a longitudinal position of the base relative to a gliding board, heel-to-toe position of the base relative to a gliding board or an angular position of the base relative to a gliding board when the base is secured to the gliding board, the adjustment indicator comprising an indicator element attached to the binding that is adapted to remain stationary relative to the gliding board as the base and footbed are moved in a heel-to-toe direction relative to the gliding board, the indicator element including a portion that depends from a bottom of the footbed and is adapted to engage with the gliding board.

15. The binding of claim 14, wherein the depending portion is adapted to engage with a longitudinal slot in the gliding board.

16. The binding of claim 14, wherein the adjustment indicator allows for determination of any two of a longitudinal position of the base relative to a gliding board, heel-to-toe position of the base relative to a gliding board or an angular position of the base relative to a gliding board when the base is secured to the gliding board.

17. The binding of claim 14, wherein the adjustment indicator allows for determination of a longitudinal position of the base relative to a gliding board, heel-to-toe position of the base relative to a gliding board and an angular position of the base relative to a gliding board when the base is secured to the gliding board.

18. A binding for use with a gliding board, comprising:

a footbed constructed and arranged to support a rider's foot;

a base constructed and arranged to be secured to a gliding board and to releasable engage with the footbed portion, the base being constructed and arranged to allow a rider's foot to directly contact the gliding board when secured to the gliding board without the footbed;

at least one foot engagement member secured to the base and constructed and arranged to secure the rider's foot relative to the base; and a highback secured to the base and constructed and arranged to support a rider's leg;

wherein the footbed includes an adjustment indicator that allows for determination of a longitudinal position of the base relative to a gliding board, heel-to-toe position of the base relative to a gliding board or an angular position of the base relative to a gliding board when the base is secured to the gliding board, the adjustment indicator comprising an indicator element attached to the binding that is adapted to remain stationary relative to the gliding board and is arranged to move within a cavity in the footbed as the base and footbed are moved in a heel-to-toe direction relative to the gliding board.

19. The binding of claim 18, wherein the base includes a pair of opposed sidewalls extending in a heel-to-toe direction, and a heel hoop that connects a heel end of the sidewalls.

20. The binding of claim 19, wherein the base further includes a crossbar that extends between the sidewalls, and wherein the footbed is arranged to be fastened to the crossbar.

21. The binding of claim 19, wherein the at least one foot engagement member includes a binding strap having an engagement portion engageable with, and selectively separable from, a buckle portion, and the sidewalls are each adapted to engage with an end of the engagement portion or the buckle portion.

22. The binding of claim 18, wherein the footbed includes a heel portion and a toe portion, and wherein the toe portion is movable in a heel-to-toe direction relative to the heel portion.

23. The binding of claim 22, wherein the heel portion of the footbed is engageable with the base such that the heel portion is maintained stationary with respect to the base, and wherein the toe portion is moveable in the heel-to-toe direction relative to the heel portion with the heel portion maintained stationary relative to the base.

24. A binding for use with a gliding board, comprising:

a footbed constructed and arranged to support a rider's foot;

a base constructed and arranged to be secured to a gliding board and to releasably engage with the footbed portion, the base being constructed and arranged to allow a rider's foot to directly contact the gliding board when secured to the gliding board without the footbed;

at least one foot engagement member secured to the base and constructed and arranged to secure the rider's foot relative to the base; and a highback secured to the base and constructed and arranged to support a rider's leg;

wherein the footbed includes an adjustment indicator that allows for determination of a longitudinal position of the base relative to a gliding board, heel-to-toe position of the base relative to a gliding board or an angular position of the base relative to a gliding board when the base is secured to the gliding board, the adjustment indicator comprising an indicator element attached to the binding that is adapted to remain stationary relative to the gliding board as the base and footbed are moved in a heel-to-toe direction relative to the gliding board and wherein the indicator element includes at least one marking indicating a position of the footbed and base relative to the gliding board in a heel-to-toe direction.

25. The binding of claim 24, wherein the footbed includes a window arranged to allow viewing of the at least one heel-to-toe marking on the indicator element.

26. A binding for use with a gliding board, comprising:

a footbed constructed and arranged to support a rider's foot;

a base constructed and arranged to be secured to a gliding board and to releasably engage with the footbed portion, the base being constructed and arranged to allow a rider's foot to directly contact the gliding board when secured to the gliding board without the footbed;

at least one foot engagement member secured to the base and constructed and arranged to secure the rider's foot relative to the base; and a highback secured to the base and constructed and arranged to support a rider's leg;

wherein the footbed includes an adjustment indicator that allows for determination of a longitudinal position of the base relative to a gliding board, heel-to-toe position of the base relative to a gliding board or an angular position of the base relative to a gliding board when the base is secured to the gliding board, the adjustment indicator comprising an indicator element attached to the binding that is adapted to remain stationary relative to the gliding board as the base and footbed are moved in a heel-to-toe direction relative to the gliding board and wherein the indicator element includes at least one marking indicating an angular position of the footbed and base relative to the gliding board.

27. The binding of claim 26, wherein the footbed includes a window arranged to allow viewing of the at least one angular position marking on the indicator element.

* * * * *